United States Patent [19]

Wall et al.

[11] 4,009,597

[45] Mar. 1, 1977

[54] ELASTIC TAPE WITH RAVEL RESISTANT EDGE AND METHOD OF KNITTING

[75] Inventors: Cothran D. Wall; John L. Overly, both of Browns Summit, N.C.

[73] Assignee: Southern Webbing Mills, Inc., Greensboro, N.C.

[22] Filed: Dec. 24, 1975

[21] Appl. No.: 644,126

[52] U.S. Cl. ..... 66/193

[51] Int. Cl.[2] ..... D04B 7/12; D04B 9/12; D04B 11/08; D04B 23/08

[58] Field of Search ..... 66/190–195, 66/172, 19, 177

[56] References Cited

UNITED STATES PATENTS 3,673,820 7/1972 Sarmiento ..... 66/177

FOREIGN PATENTS OR APPLICATIONS 1,204,354 11/1965 Germany ..... 66/19

*Primary Examiner*—Ronald Feldbaum

*Attorney, Agent, or Firm*—Bell, Seltzer, Park & Gibson

[57] ABSTRACT

Multiple wale lapping stitch loop chains are knit of additional yarn and extend over at least a pair of adjacent wales along at least one selvage edge of the elastic tape to prevent ravelling of the edge of the tape. The knitted elastic tape also includes a plurality of stitch loop chains knit of stretchable yarn and forming adjacent wales extending longitudinally of the tape and successive courses extending from one side of the tape to the other. An elastomeric yarn is inlaid in and extends along selected ones of the plurality of stitch loop chains and filling yarn extends back and forth across the tape so that the tape is stretchable in the lengthwise direction but substantially unstretchable in the widthwise direction.

15 Claims, 5 Drawing Figures

ELASTIC TAPE WITH RAVEL RESISTANT EDGE AND METHOD OF KNITTING

Figure 1:
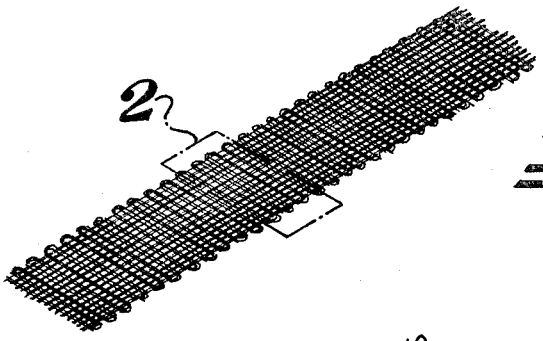

This invention relates generally to an elastic tape with a ravel resistant edge and to the method of knitting the same, and more particularly to such a tape which includes multiple wale lapping stitch loop chains knit of an additional stretchable yarn and with the stitch loops being knit in plated relationship with the stitch loops of at least adjacent pairs of the parallel stitch loop chains extending along at least one selvage edge of the tape for preventing the ravelling of the corresponding parallel stitch loop chains.

Knitted and woven elastic tapes are widely used in various portions of garments and clothing, particularly as waistbands in ladies' and men's underwear, panty hose and the like. Woven elastic tapes are more expensive to produce than knitted elastic tapes, however, the conventional type of knitted elastic tape has a tendency to ravel along its exposed edge after the garment has been worn and laundered over a period of time. This ravelling takes place because the yarn forming the stitch loop chain along the selvage edge becomes worn or broken so that the inlaid elastomeric yarn is then free to protrude outwardly from the edge of the tape. The protruding elastomeric yarn is unsightly and gives the wearer the impression that the elastic tape is no longer useful to support the garment.

With the foregoing in mind, it is an object of the present invention to provide a ravel resistant knitted elastic tape and method of knitting the same which may be produced in an economical manner on a knitting machine and which tape includes multiple wale lapping stitch loop chains knit of additional yarn and extending over at least a pair of adjacent wales along at least one selvage edge for preventing the ravelling of the corresponding edge of the tape.

In accordance with the present invention, the elastic tape includes a plurality of walewise parallel stitch loop chains knit of stretchable yarn and forming successive courses extending from one side of the fabric to the other with an elastomeric yarn inlaid in and extending along selected ones of the parallel stitch loop chains. Filling yarn extends back and forth across the fabric and is held in the parallel stitch loop chains so that the elastic tape is stretchable in the longitudinal or lengthwise direction but is substantially unstretchable in the widthwise direction. Multiple wale lapping stitch loop chains are knit of additional stretchable yarn and in plated relationship with the stitch loops of at least a pair of the parallel stitch loop chains extending along one selvage edge of the fabric for preventing ravelling of the corresponding parallel stitch loop chains.

The parallel stitch loop chains of the elastic tape are preferably independent of adjacent stitch loop chains and are connected thereto only by the filling yarns while the independent parallel stitch loop chains along at least one selvage are connected together by both the filling yarns and the multiple wale lapping stitch loop chains. It is preferred that the multiple wale lapping stitch loop chains are knit in plated relationship with a pair of adjacent parallel stitch loop chains at one or both selvage edges. However, multiple wale lapping stitch loop chains may also be knit in plated relationship with adjacent pairs of parallel stitch loop chains throughout the entire width or in selected portions of the width of the tape. It is also preferred that first and second filling yarns be provided with one filling yarn positioned on one side of the inlaid elastomeric yarn and the other filling yarn being positioned on the opposite side of the inlaid elastomeric yarn so that the parallel stitch loop chains extend through and bind the filling yarns to opposite sides of the inlaid elastomeric yarn.

Figure 2:
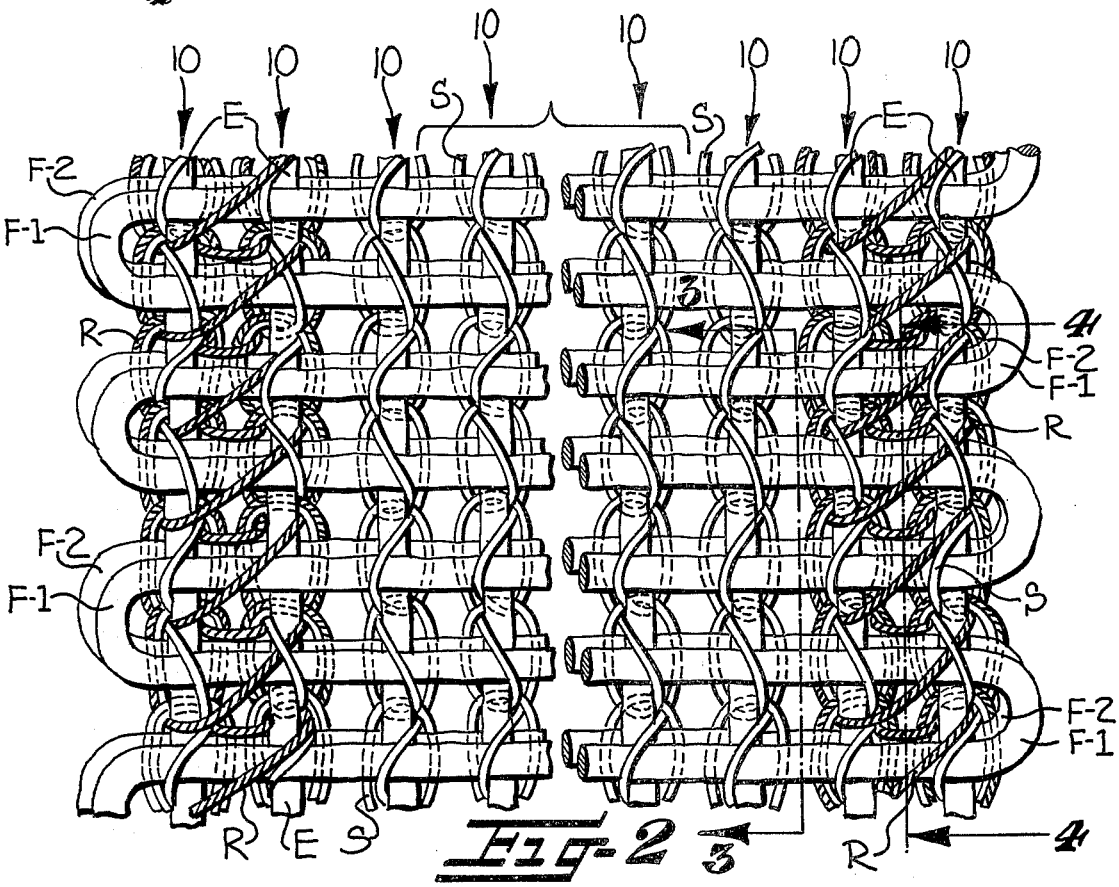
Figure 3:
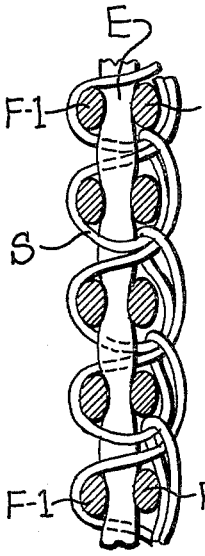
Figure 4:
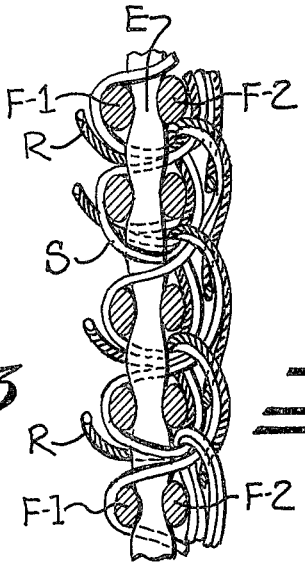
Figure 5:
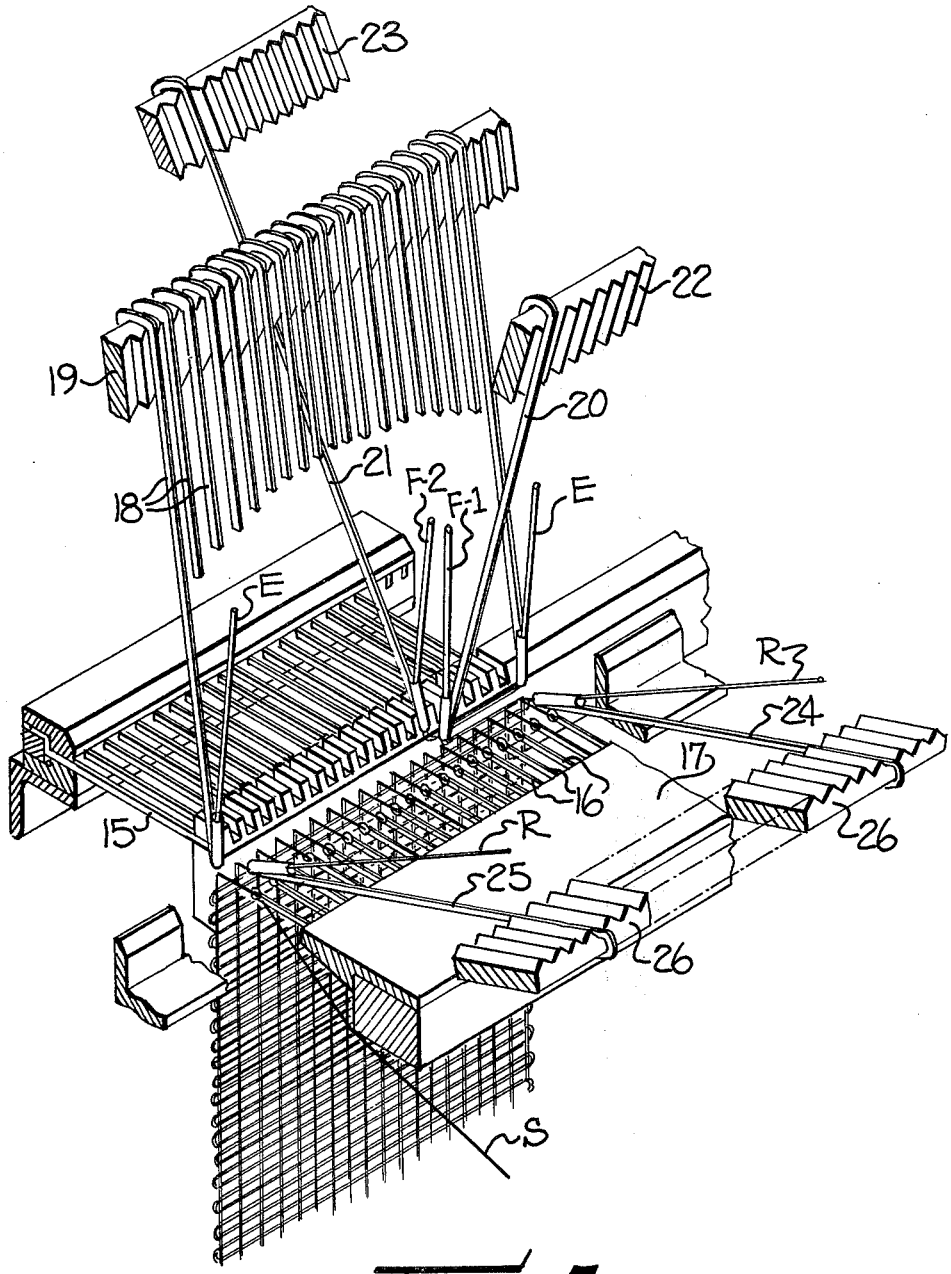

Other objects and advantages will appear as the description proceeds when taken in connection with the accompanying drawings, in which:

FIG. 1 is a fragmentary isometric view of a short length of the elastic tape of the present invention;

FIG. 2 is a greatly enlarged elevational view of a fragmentary portion of the tape illustrated in FIG. 1, with a central portion broken away, and illustrating the manner in which the parallel stitch loop chains hold the filling yarns and the inlaid elastomeric yarns together and showing the additional stretchable yarn being knit in multiple wale lapping stitch loop chains along each selvage edge of the tape;

FIG. 3 is a fragmentary vertical sectional view taken substantially along the line 3—3 in FIG. 2 and showing the manner in which the parallel stitch loop chains bind together the filling yarns and the inlaid elastomeric yarns;

FIG. 4 is a view similar to FIG. 3 but being taken substantially along the line 4—4 in FIG. 2 and showing the additional stretchable yarn being knit in multiple wale lapping stitch loop chains and in plated relationship with the stretchable yarn forming the parallel stitch loop chains; and FIG. 5 is a somewhat schematic fragmentary isometric view of a portion of a machine for knitting the elastic tape and illustrating the manner in which the various yarns are fed to the needles of the knitting machine.

The elastic tape is illustrated and described as being a relatively narrow tape with multiple wale lapping stitch loop chains formed in plated relationship with the stitch loops of adjacent pairs of the parallel stitch loop chains extending along each selvage edge of the tape to prevent ravelling of the corresponding edges of the tape. However, it is to be understood that the multiple wale lapping stitch loop chains could be formed along only the exposed selvage edge of the tape since the tape is usually attached to a garment along only one edge and the attached edge does not normally ravel. Also, it is to be understood that the present invention is not limited to use with narrow elastic tape but may be utilized with other types of knit elastic fabrics which may be relatively wide and useful for various purposes, such as forming elastic panels in girdles, forming surgical body binders and the like. In addition to providing the ravel resistant multiple wale lapping stitch loop chains at one or both selvages, they may also be utilized in selected portions or throughout the entire width of the elastic fabric to prevent ravelling of the parallel stitch loop chains in medial portions of the fabric.

As illustrated in FIG. 2, the elastic tape includes a plurality of walewise extending parallel stitch loop chains, broadly indicated at 10, which are knit of stretchable yarn S to form successive courses extending transversely and from one side of the fabric to the other. First and second filling yarns F-1 and F-2 extend back and forth across the tape and are held in the stitch loop chains of each of the courses. The filling yarns F-1 and F-2 are substantially larger than the stretchable yarn S and are crimped to provide bulk but are substantially unstretchable.

An elastomeric yarn E is inlaid in and extends along selected ones of the parallel stitch loop chains 10, illustrated as being inlaid in every stitch loop chain in FIG. 2. The elastomeric yarn E may be of any suitable natural or synthetic material, such as rubber, elastomer or spandex and is preferably laid in the tape in uncovered or raw condition. The manner in which the filling yarns F-1 and F-2 are incorporated in each course of the tape is clearly illustrated in FIGS. 2 and 3. It is preferred that the first filling yarn F-1 extends back and forth across the tape and on one side or in front of the inlaid elastomeric yarn E while the second filling yarn F-2 extends across the tape and on the other side or in back of the elastomeric yarn E. Both the first and second filling yarns F-1 and F-2 are held in position in each course of the tape and between the stitch loops on the face of the tape and the laps of the stretchable yarn S on the rear side of the tape.

The edges of the elastic tape are ravel resistant because of the multiple wale lapping stitch loop chains knit of stretchable yarn R, shown striped in the drawings for ease of identification. The multiple wale lapping stitch loop chains are illustrated as being formed in a pair of adjacent parallel stitch loop chains 10 at each selvage of the tape. However, it is to be understood that these multiple wale lapping stitch loop chains could be made wider, if desired. The multiple wale lapping stitch loop chains are knit in plated relationship with the stitch loops of the corresponding parallel stitch loop chains 10 and prevent ravelling of these parallel stitch loop chains, should the yarn become worn or broken so that the inlaid elastomeric yarn E will remain interknit and bound to the tape.

As has been stated, the width of the elastic tape of the present invention may be varied as desired and a variety of sizes and types of yarns may be used in knitting the tape. When the elastic tape is to be used in the waist of men's underwear and the like, the tape is usually knit about 1 to 1¼ inches wide and includes approximately 15 to 19 parallel stitch loop chains 10 across the width thereof. The stretchable yarn S forming the parallel stitch loop chains is a textured synthetic yarn within the range of about 70 to 300 denier, while the filling yarns F-1 and F-2 are in the range of about 150 to 900 denier each and the inlaid elastomeric yarn E is uncovered and in the range of about 140 denier to 3,600 denier. The stretchable yarn R forming the two wale lapping stitch loop chains at each selvage is in the range of about 15 to 300 denier.

As a specific, but non-limiting example, it has been found that a satisfactory 1 inch wide elastic tape is provided when the yarn S forming the parallel stitch loop chains 10 is a synthetic textured yarn of 150 denier, the elastomeric inlaid yarn E is uncovered and it is 1,680 denier, the filling yarns F-1 and F-2 are each textured non-stretchable yarn of 300 denier each, and the yarn R forming the multiple wale lapping stitch loop chains is stretchable and 70 denier. This 1 inch wide elastic tape includes approximately 15 parallel stitch loop chains 10 extending across the width of the tape.

METHOD OF KNITTING

The elastic tape of the present invention will be described as it is knit on a Comez knitting machine of the type generally illustrated in FIG. 5. However, it is to be understood that the present tape may be knit on other types of knitting machines. The knitting machine includes a flat bed of horizontally movable latch needles 15 and a plurality of elastic tapes are simultaneously knitted across the width of the knitting machine and in side-by-side relationship. Individual chain stitch yarn guides 16 are supported in a bed 17 which reciprocates or shifts back and forth during each knitting stroke or cycle of the needles 15 to form successive courses of stitch loops in the parallel stitch loop chains 10 of the tape, as illustrated in FIG. 2. The stretchable textured yarns S are fed through the chain stitch guides 16 and continuously lapped around the same needles during each knitting stroke.

The elastomeric yarns E are guided to the needles through a plurality of guide tubes supported on the lower ends of yarn guides 18 which are supported at their upper ends on a reciprocating bar 19. The bar 19 is shifted back and forth following each knitting stroke and from one side to the other of each of the needles across the width of the fabric. Although the lower ends of only two of the yarn guides 18 are shown, it is to be understood that all of the yarn guides extend downwardly and feed the yarns E to a position closely above the reciprocating latch needles 15. Thus, the elastomeric yarn E is inlaid in each of the parallel stitch loop chains 10, as illustrated in FIG. 2.

Yarn guide tubes are supported on the lower ends of sets of yarn guides 20, 21 which are supported at their upper ends on respective reciprocating support bars 22, 23. Preceding the knitting of each course of the parallel stitch loop chains 10, the yarn guides 20, 21 are moved from one side of the elastic tape to the other to feed the first and second filling yarns F-1 and F-2 in front of and behind the elastomeric yarns E so that these filling yarns F-1 and F-2 are laid in the tape in a transverse direction. When the next course is knit, the inlaid filling yarns F-1 and F-2 are bound on opposite sides of the elastomeric yarn E by the parallel stitch loop chains 10 as stitch loops are formed on one face of the tape while laps are formed on the other side, as illustrated in FIG. 3.

To form the multiple wale lapping stitch loop chains of the yarn R at each side of the tape, yarn guide tubes are supported on the ends of yarn guides 24, 25, which are supported at their other ends on a reciprocating bar 26 which shifts back and forth. The bar 26 is also provided with a rocking action so that the yarn guides 24, 25 wrap the yarns R around the two endmost needles during each knitting cycle and while the latch needles 15 are in a forward position. As the latch needles 15 move to a rearmost position, they simultaneously form stitch loops of the yarn S and the yarn R in plated relationship on the face of the fabric, as illustrated in FIG. 2. The two endmost needles also form a two wale lap of the yarn R and the two adjacent stitch loop chains 10 are joined together by a horizontal extension of the yarn R.

The multiple wale lapping stitch loop chains knit of the stretchable yarn R at each selvage of the tape thus bind together the two selvage stitch loop chains 10 to prevent ravelling of the corresponding parallel stitch loop chains, should one of the yarns along either selvage become worn or broken.

In the drawings and specification there has been set forth a preferred embodiment of the invention, and although specific terms are employed, they are used in a generic and descriptive sense only and not for purposes of limitation.

That which is claimed is:

1. A warp knit elastic fabric including at least one edge portion resistant to ravelling and including a. a plurality of walewise parallel stitch loop chains knit of stretchable yarn and forming successive courses extending from one side of said fabric to the other, b. an elastomeric yarn inlaid in and extending along selected ones of said parallel stitch loop chains, c. filling yarn extending back and forth across said fabric and being held in said stitch loop chains, and d. at least one multiple wale lapping stitch loop chain knit of stretchable yarn and forming stitch loops knit in plated relationship with the stitch loops of at least a pair of said parallel stitch loop chains extending along one selvage edge of said fabric for preventing ravelling of the corresponding parallel stitch loop chains.

2. A fabric according to claim 1 wherein certain of said parallel stitch loop chains are independent of adjacent stitch loop chains and are connected thereto only by said filling yarns, and wherein others of said parallel stitch loop chains are connected together by both said filling yarns and said multiple wale lapping stitch loop chains.

3. A fabric according to claim 1 wherein said multiple wale lapping stitch loop chains are knit in plated relationship with two adjacent parallel stitch loop chains.

4. A fabric according to claim 1 wherein said fabric is approximately one inch wide and includes approximately fifteen of said parallel stitch loop chains across the width thereof.

5. A fabric according to claim 1 wherein said elastomeric yarn is inlaid in all of said parallel stitch loop chains.

6. A fabric according to claim 3 wherein said two wale overlapped stitch loop chains are knit in plated relationship with said parallel stitch loop chains in the two wales adjacent only one selvage of said fabric.

7. A fabric according to claim 1 wherein said elastomeric inlaid yarn is uncovered and in the range of about 140 denier to 3,600 denier.

8. A fabric according to claim 1 wherein said stretchable yarn forming said parallel stitch loop chains is a textured synthetic yarn within the range of about 70 to 300 denier.

9. A fabric according to claim 1 wherein said filling yarn is in the range of about 150 to 900 denier.

10. A fabric according to claim 1 including first and second filling yarns extending back and forth across the fabric and wherein said first filling yarn is positioned on one side of said inlaid elastomeric yarn and said second filling yarn is positioned on the opposite side of said inlaid elastomeric yarn.

11. A fabric according to claim 3 wherein said yarn forming said two wale lapping stitch loop chains is stretchable and in the range of about 15 to 300 denier.

12. A fabric according to claim 10 wherein said stretchable yarn forming said parallel stitch loop chains is a textured synthetic yarn of 150 denier, wherein said elastomeric inlaid yarn is uncovered and is 1,680 denier, wherein said first and second filling yarns are each textured and nonstretchable and are each 300 denier, and wherein said yarn forming said multiple wale lapping stitch loop chains is stretchable and is 70 denier.

13. A method of forming a warp knit elastic fabric including at least one edge portion resistant to ravelling and comprising the steps of a. knitting a plurality of walewise parallel stitch loop chains of stretchable yarn and forming successive courses extending transversely of the fabric, and while b. inlaying an elastomeric yarn in and extending along selected ones of said parallel stitch loop chains, c. inlaying filling yarn in a back and forth manner across the width of said fabric and during the formation of said stitch loop chains so that said filling yarn is held in the stitches in successive courses of said stitch loop chains, and d. lapping stretchable yarn around at least a pair of adjacent needles on at least one selvage of the fabric to form a multiple wale lapping stitch loop chain in plated relationship with the stitch loops of adjacent pairs of said parallel stitch loop chains extending along said one selvage edge of the fabric to prevent ravelling of the corresponding parallel stitch loop chains.

14. A method according to claim 13 including the step of inlaying said elastomeric yarn in all of said parallel stitch loop chains.

15. A method according to claim 13 including the step of knitting said overlapped stretchable yarn in plated relationship with said parallel stitch loop chains in the two wales adjacent each selvage of the fabric.

* * * * *